United States Patent [19]

Blomstrom

[11] 4,304,142

[45] Dec. 8, 1981

[54] OPERATOR CAB TILTING APPARATUS

[75] Inventor: Gary D. Blomstrom, Princeton, Iowa

[73] Assignee: Caterpillar Tractor Co., Peoria, Ill.

[21] Appl. No.: 142,571

[22] PCT Filed: Jan. 30, 1980

[86] PCT No.: PCT/US80/00108

§ 371 Date: Jan. 30, 1980

§ 102(e) Date: Jan. 30, 1980

[87] PCT Pub. No.: WO81/02143

PCT Pub. Date: Aug. 6, 1981

[51] Int. Cl.[3] ..... F16H 21/44; B62D 33/06

[52] U.S. Cl. ..... 74/105; 74/99 R; 180/89.15; 180/89.18

[58] Field of Search ..... 74/99 R, 101, 102, 105; 180/89.13, 89.14, 89.15, 89.17, 89.18; 296/190

[56] References Cited

U.S. PATENT DOCUMENTS

| | | | |
|---|---|---|---|
| 2,362,453 | 11/1944 | Cosper | 180/89.15 |
| 3,642,316 | 2/1972 | Porth et al. | 180/89.15 |
| 3,737,192 | 6/1973 | Hirsch | 296/28 C |
| 3,747,422 | 7/1973 | Rikli | 74/99 R |
| 3,831,999 | 8/1974 | Sonneborn | 180/89.14 |
| 3,933,262 | 1/1976 | Cresp | 180/89.15 |
| 3,948,341 | 4/1976 | Foster | 180/89 A |
| 4,035,016 | 7/1977 | Ricca | 296/28 C |
| 4,053,178 | 10/1977 | York et al. | 180/89.15 |

FOREIGN PATENT DOCUMENTS

| | | | |
|---|---|---|---|
| 620223 | 5/1961 | Canada | 74/99 R |
| 1065150 | 9/1959 | Fed. Rep. of Germany | 74/105 |
| 866900 | 5/1961 | United Kingdom | 74/99 R |
| 493389 | 2/1976 | U.S.S.R. | 296/190 |

*Primary Examiner*—Lawrence J. Staab

*Attorney, Agent, or Firm*—Frank L. Hart

[57] ABSTRACT

An apparatus (38) for tilting a pivotally mounted vehicle operator cab (21) has an actuator (40) for exerting a tilting force, a link (60) for directing the tilting force in a direction substantially perpendicular to the longitudinal axis (58) of the actuator (40), and a strut (46) for absorbing a substantial portion of the tilting force to prevent damage to the vehicle elements.

10 Claims, 3 Drawing Figures

10
14
20
40
42
44
45
30
28
46
$F_a$
$F_L$
58
56
60
62
21
22
24
26
32
34

10
12
14
18
20
21
22
24
26
28
30
40
42
44
45
46
56
58
60
62
A
B

OPERATOR CAB TILTING APPARATUS

DESCRIPTION

1. Technical Field

This invention relates generally to tilting mechanisms and more particularly, but without restriction to the use which is shown and described, to a tilting mechanism for a pivotally mounted vehicle operator cab.

2. Background Art

Operator platforms and cabs for trucks, earthmoving vehicles, and the like are often mounted directly over the engine, transmission, hydraulic system, and other vehicle components. To permit access to these areas for servicing or repairs, operator cabs are often pivotally mounted on the vehicle frame to facilitate raising the cab from a substantially horizontal operating position to an upwardly tilted position exposing the vehicle components.

Operator platforms on earthmoving equipment are frequently equipped with roll-over protective structures (ROPS) or roll bars and removable enclosure panels forming compartments for the protection of the operator and the controls against the weather. To obtain sufficient exposure of the vehicle components, it is often necessary to raise the compartment and platform, or cab unit, past an overcenter position where the center of gravity of the compartment is located directly over the pivot axis. It is extremely important to prevent free fall of the cab as it is being raised or lowered on either side of the overcenter position. Such free fall can cause extensive damage to the enclosure panels and to the other parts of the vehicle.

In the past, hydraulic actuating systems or mechanically operated jacks have been employed to tilt pivotally mounted operator cabs. Prior art systems of this type are disclosed in U.S. Pat. No. 3,831,999 issued to Sonneborn, Aug. 27, 1974 and U.S. Pat. No. 4,053,178 issued to York et al, Oct. 11, 1977 and assigned to the assignee of the present invention.

While such tilting mechanisms have gained wide acceptance, they are subject to certain limitations. For example, the nature of the hydraulic system is such that fluid trapped in certain parts of the system prevents motion in one or both directions of the actuator, which interferes with the vehicle suspension. Thus, a more complicated and costly suspension system is required to overcome this problem.

Another problem associated with such prior art mechanisms arises from their location and manner of operation. Typically, conventional tilt mechanisms are permanently mounted to the vehicle frame beneath the platform. They exert a tilting force on a relatively structurally strong member of the platform, for example the base or a lever extending therefrom, as opposed to the relatively weak enclosure panels which would be crushed by the stress, especially if the platform is improperly released from the frame. Therefore, each individual vehicle produced by a given manufacturer employing these or similar tilting devices would come so equipped, a factor which translates into increased costs, especially to a multiple vehicle owner where a single unit could feasibly service several vehicles.

The foregoing illustrates limitations of the known prior art. Thus, it is apparent that it would be advantageous to provide an alternative to the prior art in the form of a releasable operator cab tilting apparatus which can be expeditiously connected to the cab without imparting damage thereto.

DISCLOSURE OF THE INVENTION

In one aspect of the present invention, the problems pertaining to the known prior art, as set forth above, are advantageously avoided. This is accomplished by providing an operator cab tilting apparatus including a power source for exerting a force for tilting an operator cab, a member directing the force exerted by the power source to the cab, and a member absorbing a portion of the exerted force to prevent damage to the cab.

This invention therefore provides an operator cab tilting apparatus which may be expeditiously connected to and removed from a vehicle, thereby eliminating the need to have a tilting apparatus on each individual vehicle. The apparatus of the instant invention further applies the tilting force exerted by the power source to the cab in a manner which prevents structural damage to its components.

BRIEF DESCRIPTION OF THE DRAWINGS

Further objects of the invention together with additional features contributing thereto and advantages accruing therefrom will be apparent from the following description of a preferred embodiment of the invention which is shown in the accompanying drawings with like reference numerals indicating corresponding parts throughout, wherein.

BEST MODE FOR CARRYING OUT THE INVENTION

Figure 1:
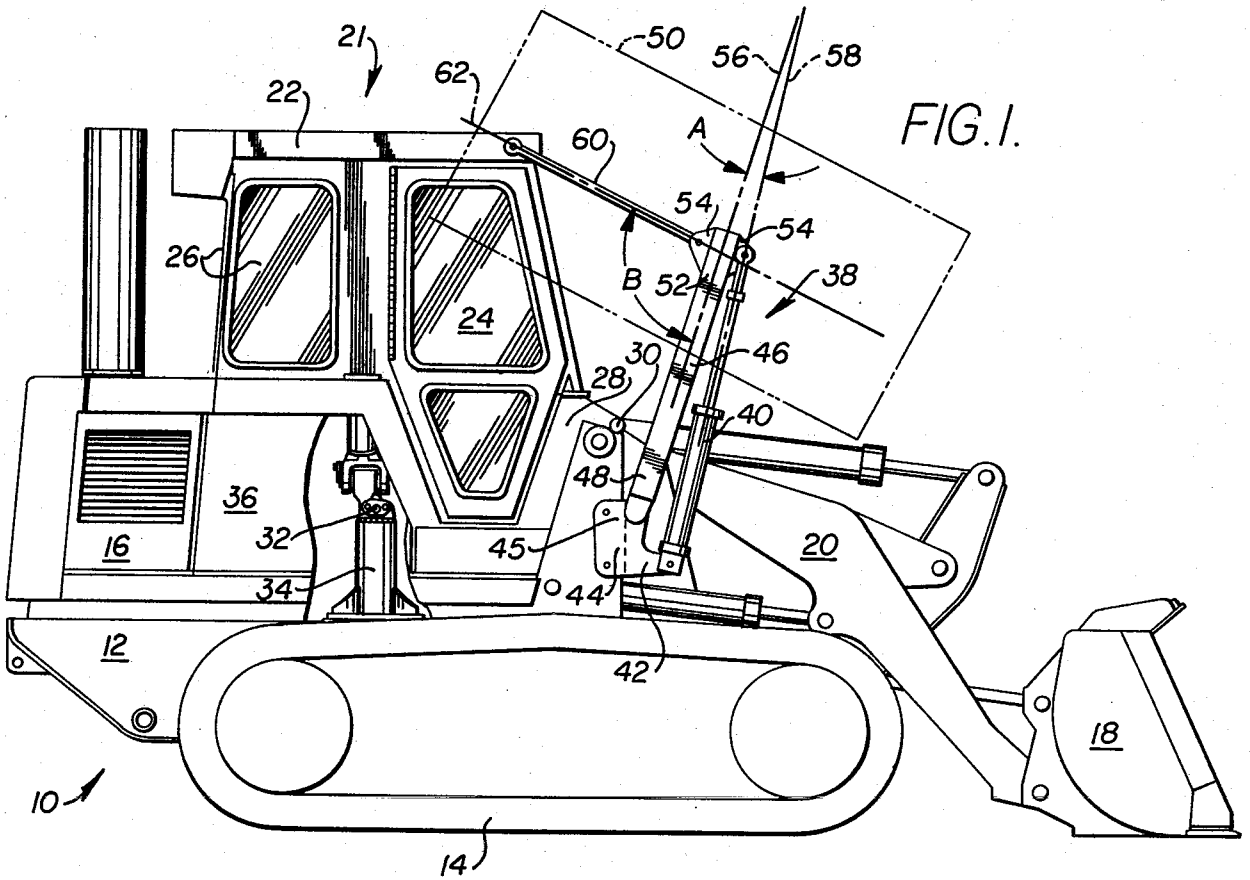
FIG. 1 is a side elevational view of an earthmoving vehicle embodying the present invention with portions removed to better illustrate the components thereof.

Referring to FIG. 1, an earthmoving vehicle 10 employing the present invention includes a frame 12 supported by an undercarriage and driven by a pair of endless track chains 14. The vehicle has a power unit 16, a bucket 18, a bucket linkage 20, and an operator cab 21. The operator cab includes a roll-over protection structure (ROPS) 22 and an operator compartment 24 formed by removable enclosure panels 26 secured at the top to the ROPS and at the bottom to an operator platform 28. The front portion of the platform is pivotally mounted to the frame at a hinge point 30, and the rear portion is releaseably secured by a removable pin 32 to a mounted pedestal 34 attached to the frame.

Figure 2:
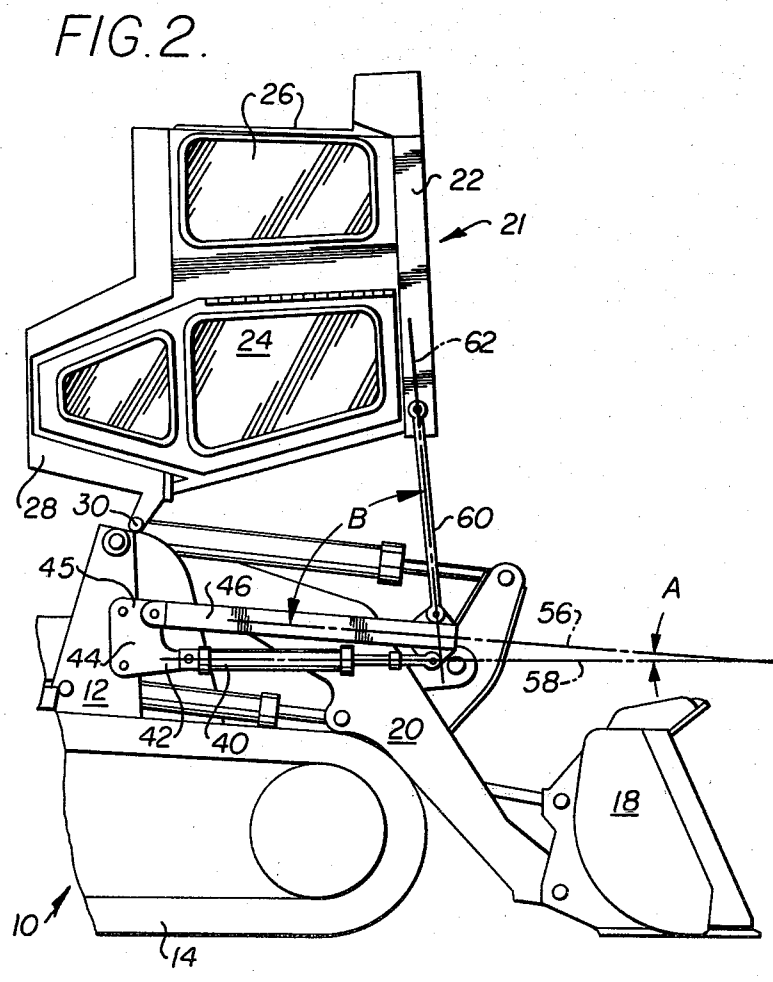
FIG. 2 is a side elevational view of a portion of an earthmoving vehicle embodying the present invention showing the operator cab in the raised position.

Accessibility to area 36 is necessary for maintenance and repairs. Therefore, according to the present invention, an operator cab tilting apparatus 38 is secured to the vehicle 10 for raising the platform and compartment 24, as is best illustrated in FIG. 2.

The tilting apparatus 38 includes a hydraulic actuator 40 pivotally secured at one end to the frame 12 by one leg 42 of an L-shaped mounting bracket 44. The actuator includes a relief valve (not shown) such as disclosed in U.S. Pat. No. 3,523,490 issued to Bianchetta, Aug. 11, 1970 and assigned to the assignee of the instant invention, to prevent free fall of the cab as it passes to either side of the over-center position.

A force absorbing beam or strut 46 is pivotally secured at its proximate end 48 to the frame 12 by the other leg 45 of the bracket 44. The strut is positioned so as to extend substantially parallel to but slightly skewed along the length of the actuator 40 and in close proximity thereto forming a plane 50. The distal end 52 of the strut includes a pair of outwardly extending brackets or ears 54. The other end of the actuator is pivotally connected to one of the ears in a manner such that in operation, the angle A between the longitudinal axes 56,58 of the strut and the actuator falls within the range of approximately 1° to 90°, preferably within the range of approximately 4° to 10°.

A link 60 lying in the same plane 50 formed by the strut 46 and the actuator 40, extends between the operator cab 21 and the strut 46, being substantially perpendicular to the latter. One end of the link is pivotally attached to the other of the outwardly extending pair of ears 54 on the distal end 52 of the strut. The other end of the link is pivotally secured to the cab in such a manner that, as the compartment is raised or lowered, the angle B between the longitudinal axes 56,62 of the strut and the link falls within the range of approximately 0° to 180°, preferably in the range of approximately 70° to 110°.

Industrial Applicability

In the operation of the present invention as taught by the above description, when access to the area 36 beneath the operator platform 28 is needed, the mounting bracket 44 is attached to the vehicle frame 12. The tilting apparatus 38 is connected to the mounting bracket with the actuator 40 in the retracted position. Typically, the actuator is connected to an auxiliary source of hydraulic pressure, for example, a hand jack (not shown). The actuator is then extended raising the apparatus so that the link 60 may be attached to the cab 21. After disconnecting the necessary electrical, hydraulic, and control lines extending between the vehicle frame and the cab and after releasing the platform from the mounting pedestal 34 by removing the pin 32, the cab is raised by retracting the actuator.

Figure 3:
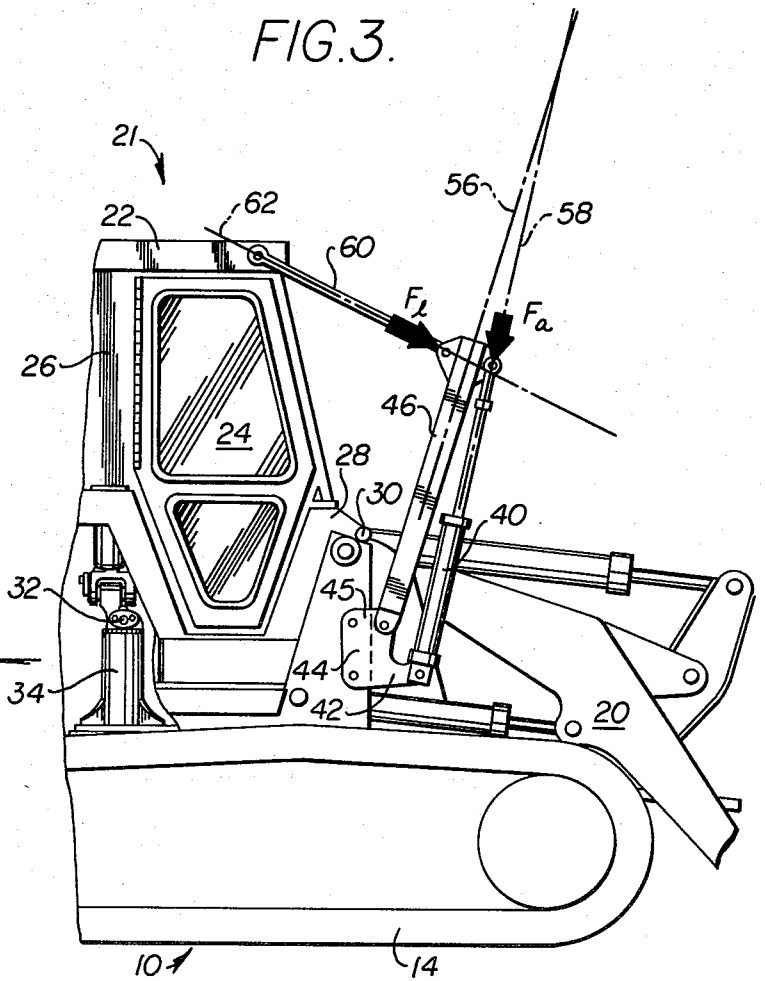
FIG. 3 is a side elevational view of the earthmoving vehicle of FIG. 1 with a force diagram applied thereto.

As best illustrated in FIG. 3, the actuator 40 exerts a force $F_a$. This force is substantially larger than the force necessary to tilt the platform 28 and compartment 22, typically in the range of 20,000 to 30,000 pounds. Applying a force of this magnitude directly to the forward portion of the cab 21 would buckle the ROPS 22 and damage the panels 26 or shear the pin 32 in the event that the platform was not properly released. However, since the actuator is pivotally connected nearly parallel to the strut 46, a significant portion of the force applied by the actuator will be absorbed by the strut. The remaining force, $F_1$, is applied substantially in a horizontal position to the operator cab and is typically in the range of 2,000 to 4,000 pounds, preferably approximately 3,000 pounds. A force of this magnitude is sufficient to tilt the cab without causing any damage thereto, and the relief valve in the actuator prevents free fall of the cab as it passes through the over-center position.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed, but that the invention will include all embodiments falling within the scope of the appended claims.

I claim:

1. An apparatus (38) for moving a first member (21) pivotally connected to a second member (12) comprising:

power means (40) for exerting a force and pivotally moving the first member (28);

means (60) connected to the first member (21) for directing the force generated by the power means (40);

force absorbing means (46) interconnecting the force directing means (60) and the power means (40) for effectively isolating a portion of the force generated by the power means (40) from said first member (21), said power means (40) and said force absorbing means (46) each having a longitudinal axis (58,56), said axes (58,56) being positioned within a first predetermined angle (A) having a range of approximately 4° to approximately 10°.

2. The apparatus of claim 1 wherein said force absorbing means (46) is connected to the second member (12).

3. The apparatus of claim 1 wherein the power means (40) is connected to the second member (12) in a relatively closely spaced, juxtaposed relation with the force absorbing means (46).

4. The apparatus of claim 1 wherein the power means (40) is a double acting hydraulic cylinder (40).

5. The apparatus of claim 1 wherein the force directing means (60) is a link (60) interconnecting the first member (21) and the force absorbing means (46).

6. The apparatus of claim 1 wherein the force absorbing means (46) is in the form of a strut (46).

7. The apparatus of claim 6 wherein the strut (46) includes first and second end portions (48,52), the first end portion (48) being connected to the second member (12) and the second end portion (52) being connected to the force directing means (60).

8. The apparatus of claim 1 wherein the power means (40), the force directing means (60), and the force absorbing means (46) lie substantially in the same plane (50).

9. The apparatus of claim 1 wherein the force directing means (60) has a longitudinal axis (62), said axis (62) of the force directing means (60) and said axis (56) of the force absorbing means (46) being positioned within a second preselected angle (B), said second preselected angle (B) having a range of approximately 70° to approximately 110°.

10. The apparatus of claim 1 wherein the apparatus (38) is releasably connected to the first and to the second members (21,12).

* * * * *